US007334358B1

(12) United States Patent
Whyte

(10) Patent No.: US 7,334,358 B1
(45) Date of Patent: Feb. 26, 2008

(54) PORTABLE DREDGING EQUIPMENT

(76) Inventor: Colin D Whyte, P.O. Box 308, West Tisbury, MA (US) 02575

( * ) Notice: Subject to any disclaimer, the term of this patent is extended or adjusted under 35 U.S.C. 154(b) by 250 days.

(21) Appl. No.: 11/273,308

(22) Filed: Nov. 14, 2005

(51) Int. Cl.
*E02F 3/88* (2006.01)

(52) U.S. Cl. ..... 37/320; 37/324; 37/326; 37/343; 56/8; 56/9

(58) Field of Classification Search ..... 37/309, 37/317, 319–324, 326, 342–344; 56/8, 9
See application file for complete search history.

(56) References Cited

U.S. PATENT DOCUMENTS

| | | | | |
|---|---|---|---|---|
| 281,905 | A * | 7/1883 | Meinesz | 37/342 |
| 509,286 | A * | 11/1893 | Bentinck et al. | 37/343 |
| 1,062,924 | A * | 5/1913 | Mercer | 37/342 |
| 3,504,943 | A * | 4/1970 | Sheary et al. | 299/8 |
| 4,222,217 | A * | 9/1980 | Brown | 56/9 |
| 4,854,058 | A * | 8/1989 | Sloan et al. | 37/323 |
| 4,889,391 | A * | 12/1989 | Cornelius | 299/9 |
| 4,957,622 | A * | 9/1990 | Mims | 210/170.04 |
| 5,146,997 | A * | 9/1992 | Korin | 172/42 |
| 5,152,126 | A * | 10/1992 | Cousineau | 37/342 |
| 6,209,965 | B1 * | 4/2001 | Borns et al. | 299/8 |
| 7,083,734 | B2 * | 8/2006 | Happonen | 210/747 |
| 7,181,871 | B2 * | 2/2007 | Sower | 37/343 |

* cited by examiner

*Primary Examiner*—Gary S. Hartmann
(74) *Attorney, Agent, or Firm*—Michael I Kroll

(57) ABSTRACT

A portable dredging apparatus comprising a cutter housing in communication with a hydraulic power supply and a discharge pump through lengths of tubing whereby said cutter housing is submersible. The cutter housing is comprised of a platform having walls depending therefrom with the cutter blade positioned therewithin and height adjustable wheels exteriorly located on opposing sides. Also extending between the walls proximate to the cutter blade is an angularly positioned wiper element designed to dislodge debris caught between the teeth of the cutter blade. Angularly depending screen situated between the wiper blade and discharge port located in the rear wall prevent objects larger than the screen mesh from discharge port passage. Releasably fastened to the exterior side of the discharge port is an appropriate length of flexible conduit terminating at a remote discharge pump with additional conduit extending from the discharge pump to a desired debris discharge location.

11 Claims, 12 Drawing Sheets

PORTABLE DREDGING EQUIPMENT

BACKGROUND OF THE INVENTION

1. Field of the Invention

The present invention relates generally to dredging equipment and more specifically, to a portable dredging apparatus comprising a cutter housing in communication with a hydraulic power supply and a discharge pump through lengths of tubing whereby said cutter housing is submersible. The cutter housing is comprised of a platform having walls depending therefrom with the cutter blade positioned therewithin and height adjustable wheels exteriorly located on opposing sides. Also extending between the walls proximate to the cutter blade is an angularly positioned wiper element designed to dislodge debris caught between the teeth of the cutter blade. Angularly depending screen situated between the wiper blade and discharge port located in the rear wall prevent objects larger than the screen mesh from discharge port passage.

Releasably fastened to the exterior side of the discharge port is an appropriate length of flexible conduit terminating at a remote discharge pump with additional conduit extending from the discharge pump to a desired debris discharge location.

Located on the topside of the cutter housing is a handle providing means for navigating the cutter housing through a cutter task and having control means mounted thereon to raise and lower the wheels and engage and disengage a deck mounted hydraulic motor powering the cutter blade.

An additional element is provided in the form of a trailer providing means for transporting the hydraulic power plant, cutter housing, discharge pump and lengths of conduit.

2. Description of the Prior Art

There are other devices designed for dredging. Typical of these is U.S. Pat. No. 1,415,113 issued to Phillips, Jr. on May 9, 1922.

Another patent was issued to Jacobsen on Jul. 29, 1952 as U.S. Pat. No. 2,605,090. Yet another U.S. Pat. No. 3,808,779 was issued to Randall on May 7, 1974 and still yet another was issued on Oct. 5, 1982 to Sloan as U.S. Pat. No. 4,352,251.

Another patent was issued to Campbell on Feb. 15, 1983 as U.S. Pat. No. 4,373,867. Yet another U.S. Pat. No. 4,409,746 was issued to Beck on Oct. 18, 1983. Another was issued to Wilson, et al. on Apr. 18, 1989 as U.S. Pat. No. 4,822,106 and still yet another was issued on Dec. 26, 1989 to Cornelius as U.S. Pat. No. 4,889,391.

Another patent was issued to Wirth on Jul. 15, 1997 as U.S. Pat. No. 5,647,691. Yet another U.S. Pat. No. 6,843,003 was issued to Araoka on Jan. 18, 2005. Another was issued to Kubosawa on Nov. 14, 1981 as Japanese Patent No. JP56146524 and still yet another was issued on Jan. 23, 1996 to Inaba as Japanese Patent No. JP8020965. Another was issued to Fujimura on Mar. 5, 1996 as Japanese Patent No. JP8060695 and still yet another was issued on Mar. 4, 1997 to Goto as Japanese Patent No. JP9060035.

U.S. Pat. No. 1,415,113

Inventor: Thomas H. Phillips, Jr.

Issued: May 9, 1922

A clam or mussel dredging apparatus comprising a pipe adapted to extend obliquely downwardly into the water and having a mouth at an angle to said pipe to rest substantially flatly on the bottom, a second pipe adjacent the first pipe-and arranged to discharge air or other gas so as to rise through the first pipe causing eruption of the bottom under said mouth and a rising current of air, water, and bottom, and means for forcing air through said second pipe.

U.S. Pat. No. 2,605,090

Inventor: K. Oscar F. Jacobsen

Issued: Jul. 29, 1952

In underwater placer mining apparatus a nozzle unit comprising a generally axially extending suction conduit having a lower end portion disposed generally upright in the nozzle unit's operative position, a plurality of suction branch conduits of substantially smaller size branching outward from said lower end portion and turned downward and generally inward at an incline to the vertical, said branch conduits terminating in lower end portions forming suction inlets for drawing of loose bottom materials into said branch conduits, pressure conduit means including a plurality of downwardly extending pressure branch conduits terminating in lower end portions forming similarly directed force jets directed generally downwardly and appreciably inwardly and tangentially about the nozzle unit's axis to create, a vortex swirl of loose bottom materials in the vicinity of said suction inlets to be drawn into said suction inlets.

U.S. Pat. No. 3,808,779

Inventor: Alan C. Randall

Issued: May 7, 1974

Diver from boat working along ocean bottom cuts Irish Moss, agar weed, or similar marine vegetation growing at depth of up to about 100', using a manually maneuvered sickle bar cutting unit which carries and is powered by a light weight air motor. Cutting unit further includes a collecting hood to which a flexible suction hose is attached for hydraulic delivery of the cut plants via an airlift, by which the suction is induced, to the surface and into a collecting strainer in or alongside the boat. Airlift is positioned just below the water surface and is spaced by the flexible suction hose a considerable distance away from the diver. Cutting unit air motor receives driving air, and diver receives breathing air from air compressor aboard the boat. Airlift receives driving air preferably from said air compressor, and cutting unit air motor preferably exhausts to atmospheric pressure, but said motor exhaust air could be utilized to drive airlift. Cutting unit oriented for side-to-side sweeping movement in cutting of plant stalks, and several hood configurations are described. Cutting blade has relatively short length, and air motor is relatively small. Airlift delivery tube receives driving air via a relatively large number of small diameter air apertures therethrough, the apertures being angled 2'0° upwardly, and the sum of their areas being 50 percent larger than the interior diameter of the delivery tube.

U.S. Pat. No. 4,352,251

Inventor: Albert H. Sloan

Issued: Oct. 5, 1982

A portable and lightweight suction dredge head which is held by a diver and is hand operated so as to be easily moved about in the working position. These heads are, for example of sizes from three inches to eight inches in intake diameter. The dredge head is used for excavating under water and is of the suction type wherein the material is conveyed away from a suction pipe from the dredge head. A jet digger may also be used with the dredge head. A manually operated valve on the dredge head permits the operator to regulate the amount of suction at the inlet of the dredge head and is capable of reducing the amount of suction so as to permit the operator to (1) adjust the density of the material being conveyed, that is regulate the amount of sludge or trash relative to the amount of water that is being conveyed, (2) control the digging aggressiveness of the dredge head, or (3) easily remove foreign material such as rocks, cans or other matter from the inlet of the dredge head or free his hand or foot if it accidently is grabbed by the dredge head. The head is rotatably mounted on the suction pipe which leads to a remote location whereby the head can be easily rotated at the most desirable digging position, and means are provided for insuring that the swivel coupling remains clear of sand or the like and freely operative. The above dredge head together with a hydraulically driven submersible pump assembly act to eliminate pump priming difficulties and pump sealing problems due to abrasive material, and provides good net positive head, horsepower, speed control, safety and mobility.

U.S. Pat. No. 4,373,867

Inventor: Gene K. Campbell

Issued: Feb. 15, 1983

A pumping system is described for pumping fluids, such as water with entrained mud and small rocks, out of underground cavities such as drilled wells, which can effectively remove fluids down to a level very close to the bottom of the cavity and which can operate solely by compressed air pumped down through the cavity. The system utilizes a subassembly having a pair of parallel conduit sections (44, 46) adapted to be connected onto the bottom of a drill string utilized for drilling the cavity, the drill string also having a pair of coaxially extending conduits. The subassembly includes an upper portion which has means for connection onto the drill string and terminates the first conduit of the drill string in a plenum (55). A compressed air-driven pump (62) is suspended from the upper portion. The pump sucks fluids from the bottom of the cavity and discharges them into the second conduit. Compressed air pumped down through the first conduit (46) to the plenum powers the compressed air-driven pump and aerates the fluid in the second conduit to lift it to the earth's surface.

U.S. Pat. No. 4,409,746

Inventor: Jeffrey L. Beck

Issued: Oct. 18, 1983

A dredging apparatus has a chamber with a substantially circular cross section. A first inlet and outlet is formed through the chamber with an axis of the inlet and outlet normal to a diameter of the chamber. A suction inlet is formed through the axis of the chamber along the axis of the vortex formed as the fluids leave the inlet and pass to a second outlet formed substantially coaxially with the vortex. Apparatus is provided for supporting the dredging apparatus in a position so that the suction inlet can remove material desired to be dredged.

U.S. Pat. No. 4,822,106

Inventor: Steven M. Wilson, et al.

Issued: Apr. 18, 1989

A golf ball dredge which comprises a shallow draft, buoyant support vessel in the form of a pontoon boat that provides a floating platform from which the dredging apparatus is supported. The pontoon boat has a small outboard motor mounted at its bow for providing a means for propulsion and steering of the boat. A relatively high pressure, gasoline powered, centrifugal water pump is mounted on the pontoon boat with its suction intake located below the water level. The pump provides a high pressure water outlet discharge that is supplied through eductor tubes into the inlet end of a bottom suction intake piping system. The bottom suction intake piping system also is supported on the pontoon boat with its inlet end submerged below the surface of the water to a suitable depth for lightly contacting the bottom of the waterhole. The high pressure water discharge from the pump is supplied through the eductor tubes to the inlet end of the suction intake piping system for creating a suction action that draws water and any entrained solids such as golf balls into the suction intake piping system. The suction intake piping system discharges under relatively high pressure water and any entrained solids into the inlet end of an automatically operable golf ball separator means supported on the pontoon boat for automatically separating out golf balls from liquid and other entrained solids contained in the suction intake piping system discharge without requiring the need for human intervention in the separating procedure.

U.S. Pat. No. 4,889,391

Inventor: Billie G. Cornelius

Issued: Dec. 26, 1989

A hand-held suction dredge and metal detector is supported on a vertically held hollow pipe. A metal detector having a central aperture is slidably supported on the pipe with the lower pipe end extending therethrough for receiving and transmitting at least partially fluid material. A spring urges the metal detector toward an initial position at the lower end of said pipe. A fluid jet is positioned in the pipe directed upward therein. A pump supported on the pipe and connected to the fluid jet circulate fluid to create a suction in the pipe to draw at least partially fluid material through the pipe to discharge the same from the upper end thereof. A perforate basket on the upper end of the pipe has openings sized to permit discharge of fluid material and retain larger metal solids therein. The pipe, in use, supports the metal detector adjacent to a region being investigated for dredging material by operation of the pump. A motor supported on the pipe operates the pump. The dredge and detector are constructed to locate metal objects in sand or loose soil, or underwater, and the pump is a high capacity air blower or water pump, and the jet is of a size and shape to induce suction through the pipe on circulation of air or water therethrough. Circularly extending trays in the basket are positioned to catch and retain solid metal objects drawn through said pipe while allowing fluid or particulate material to flow out through the openings in the basket.

U.S. Pat. No. 5,647,691

Inventor: John C. J. Wirth

Issued: Jul. 15, 1997

A method and apparatus for ecologically safely removing silt, muck, and sand from a waterbottom and for collecting the silt, muck, and sand without destroying the benthos therein into porous containers where the then contained mud and silt can be ecologically positioned where desired to enhance subaquatic environments. The apparatus includes a silt and mud collecting and transfer device that has no moving parts, thereby not endangering the benthos in the transfer process.

U.S. Pat. No. 6,843,003

Inventor: Toshinobu Araoka

Issued: Jan. 18, 2005

The gravel-or-the-like removing device includes an impeller casing which accommodates an impeller driven by a motor in the inside thereof and has a suction opening at the center of the lower surface, a peripheral wall for preventing collapse and inflow of gravel or the like which is constituted of a cylindrical body which has an upper end thereof connected to a lower portion of the impeller casing and a lower end thereof opened downwardly and forms a water-retention space in the inside thereof, and a water suction pipe which has an upper-end opening thereof opened in water above a gravel-or-the-like piled level and a lower opening thereof communicably connected with the water retention space.

Japan Patent Number JP56146524

Inventor: Minoru Kubosawa, et al.

Issued: Nov. 14, 1981

PURPOSE: To dredge sand and mud in a pit or the like at a high efficiency by providing a sand pump with a mud suction tube and a mud feed tube and a sink and float device to a body with a warped bottom section in a basket type sand/mud dredging apparatus.

CONSTITUTION: When an air suction/discharge valve 25 is opened, air is fed into a float 16 while water inside is discharged from a water suction/discharge port 16A. The float 16 comes up to float the body maintaining it at a specified position. When the air suction/discharge valve 25 is closed to halt the air supply, the air in the float 16 is discharged to reduce the pressure. As water enters the float 16, the body 11 submerges down, collects accumulated earth 9 and sucks it into a mud suction tube 13.

Japan Patent Number JP8020965

Inventor: Koji Inaba

Issued: Jan. 23, 1996

PURPOSE: To dredge hard mud with high efficiency by a method wherein agitating devices are disposed in front of and both sides of a vertical type screw conveyor and a mud collecting plate is arranged to the outside of the mud intake port of a conveyor.

CONSTITUTION: A hydraulic motor 217a is driven and agitating blades 218A and 218B of an agitating 216 are rotated to excavate mud. Excavated mud is guided to a mud suction port 214 by a mud collecting plate arranged at the back of the mud suction port 214 of a casing 211. The mud is inputted on a vertical screw conveyor 210 through a mud suction port 214 and transferred upward. Further, mud is pressurized by a pressure pump 220 and conveyed through a discharge pipe 250 by compressed air injected in the discharge pipe 250 through an ejector 260.

Japan Patent Number JP8060695

Inventor: Norihiko Fujimura, et al.

Issued: Mar. 5, 1996

PURPOSE: To dredge efficiently by mounting a plurality of edges to the bottom of a dredging cylinder, mounting a plurality of water jet nozzles to the outer periphery of the dredging cylinder, and housing turnably an impeller inside the dredging cylinder.

CONSTITUTION: Water is supplied to a water jet nozzle 9 by way of a pipe 7 mounted to a dredging cylinder 2 where the jet water is sprayed to accumulated mud, while edges 5 are pulled, thereby loosening the accumulated mud. An impeller 12 having a plurality of blades 11 installed to a rotary inner cylinder 10 is driven with a submergible motor 14, thereby agitating the loosen mud so as to turn the mud into fine particles. Furthermore, the fine particle mud is sucked up with a slurry pump installed to the top of a dredging mechanism 1.

Japan Patent Number JP9060035

Inventor: Seiichi Goto, et al.

Issued: Mar. 4, 1997

PROBLEM TO BE SOLVED: To efficiently and stably dredge suspended mud as well as soft mud.

SOLUTION: A casing 1, in the bottom face of which a opening 2 is provided, is divided into an excavation chamber 8 and a pump chamber 9 by a partition panel 7, and an excavation device 11, which excavates bottom mud 20 through the opening 2 and sends it to the pump chamber 9, and a mud pumping-up pump 12 are arranged in the excavation chamber 8 and pump chamber 9 respectively. Air pipes 28 and 29, which are used to selectively send compressed air to the excavation chamber 8 and pump chamber 9 from an air supply and exhaust device 31, are connected to the top face of the easing 1. In order to dredge soft mud, air pressure in the excavation chamber 8 is made to increase, and the pump chamber 9 is opened in the atmospheric air for performing high density dredging and the air leaked from the excavation chamber 8 to the pump chamber 9 is relieved in the atmosphere through the air pipe 29. In order to dredge suspended mud, the excavation chamber 8 is opened in the atmosphere, and air pressure in the pump chamber 9 is made to increase, and suspended mud is dredged by a suction method while preventing the production of a water passage between the opening 2 of the casing 1 and the mud pumping-up pump 12.

While these dredging devices may be suitable for the purposes for which they were designed, they would not be as suitable for the purposes of the present invention, as hereinafter described.

SUMMARY OF THE PRESENT INVENTION

A primary object of the present invention is to provide a portable dredging apparatus capable of cutting through calcified material such as coral.

Another object of the present invention is to provide a portable dredging apparatus comprising a hydraulic power plant, cutting member, discharge pump and appropriate lengths of conduit.

Yet another object of the present invention is to provide a portable dredging apparatus wherein said cutting member is submersible and connected by length of conduit to said hydraulic power plant and discharge pump.

Still yet another object of the present invention is to provide a portable dredging apparatus wherein said cutting member is comprised of a platform having walls depending therefrom having exteriorly mounted wheels for mobility.

Another object of the present invention is to provide a portable dredging apparatus wherein said cutter platform has a hydraulic motor mounted thereon driving the cutter blade.

Additional objects of the present invention will appear as the description proceeds.

The present invention overcomes the shortcomings of the prior art by providing a portable dredging apparatus comprising a cutter housing in communication with a hydraulic power supply and a discharge pump through lengths of tubing whereby said cutter housing is submersible. The cutter housing is comprised of a platform having walls depending therefrom with the cutter blade positioned therewithin and height adjustable wheels exteriorly located on opposing sides. Also extending between the walls proximate to the cutter blade is an angularly positioned wiper element designed to dislodge debris caught between the teeth of the cutter blade. Angularly depending screen situated between the wiper blade and discharge port located in the rear wall prevent objects larger than the screen mesh from discharge port passage. Releasably fastened to the exterior side of the discharge port is an appropriate length of flexible conduit terminating at a remote discharge pump with additional conduit extending from the discharge pump to a desired debris discharge location.

Located on the topside of the cutter housing is a handle providing means for navigating the cutter housing through a cutter task and having control means mounted thereon to raise and lower the wheels and engage and disengage a deck mounted hydraulic motor powering the cutter blade.

An additional element is provided in the form of a trailer providing means for transporting the hydraulic power plant, cutter housing, discharge pump and lengths of conduit.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
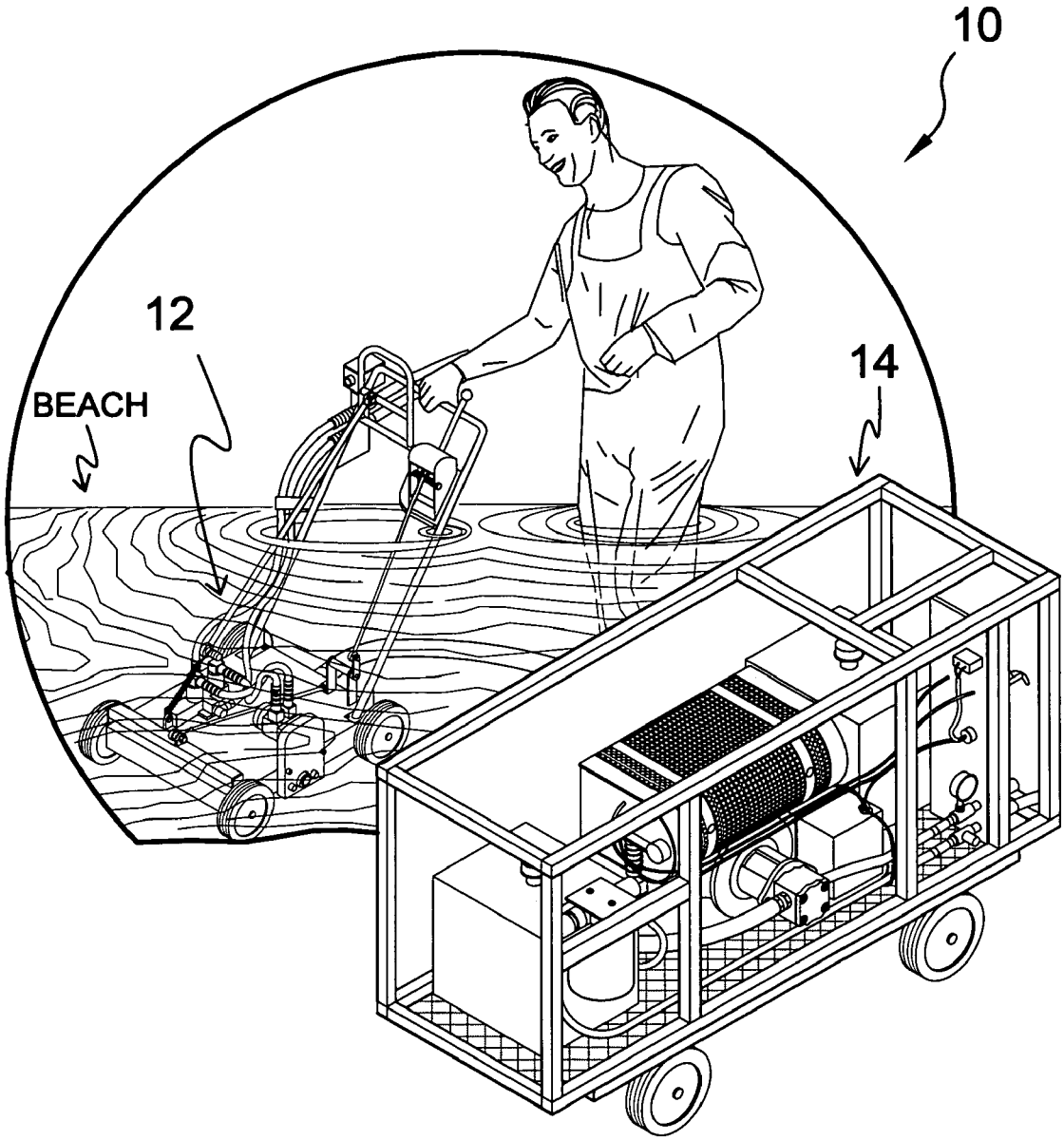
FIG. 1 is an illustrative view of the present invention in use.

Turning now descriptively to the drawings, in which similar reference characters denote similar elements throughout the several views, the figures illustrate the Portable Dredging Apparatus of the present invention. With regard to the reference numerals used, the following numbering is used throughout the various drawing figures.

10 Portable Dredging Apparatus of the present invention
12 dredge unit
14 hydraulic power plant
16 trash pump
18 housing of 12
20 platform of 18
22 sidewalls of 18
24 undercarriage of 18
26 cutting element

28 cutting blades
30 wiper blade
32 discharge port
34 screen
36 handle member
38 user controls
40 hydraulic hose lines of 12
42 hydraulic hose lines of 14
44 chain drive
46 user controls
48 cutter-depth adjustments means
50 dead man's clutch
52 emergency kill switch
54 gas tank of 14
56 battery
58 engine
60 hydraulic fluid tank
62 hydraulic fluid filter
64 hydraulic pump
66 pressure regulator
68 pressure gauge
70 throttle
71 hours meter
72 choke
73 engine muffler
74 ignition
76 suction line of 16
78 discharge line of 16
80 height-adjustable wheels
82 trailer
84 hose storage area

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. Dredging equipment is normally enormous and expensive, the dredge unit 12 of the present invention 10 is small and can enter the water from a beach or be lowered into the water by a boatlift. An area around an owner's dock or swimming area could be cleaned up and/or deepened in a matter of hours with little impact, noise or expense. The dredge unit 12 is small, similar to a large lawn mower or snow blower. Cutter blades on the underside of the mower deck loosen up mud and cut away soft stone (limestone) which is then removed through a suction hose. The cutter blades are powered by a hydraulic motor mounted on the deck. A separate hydraulic power plant 14 remains on shore or in a boat.

Figure 2:
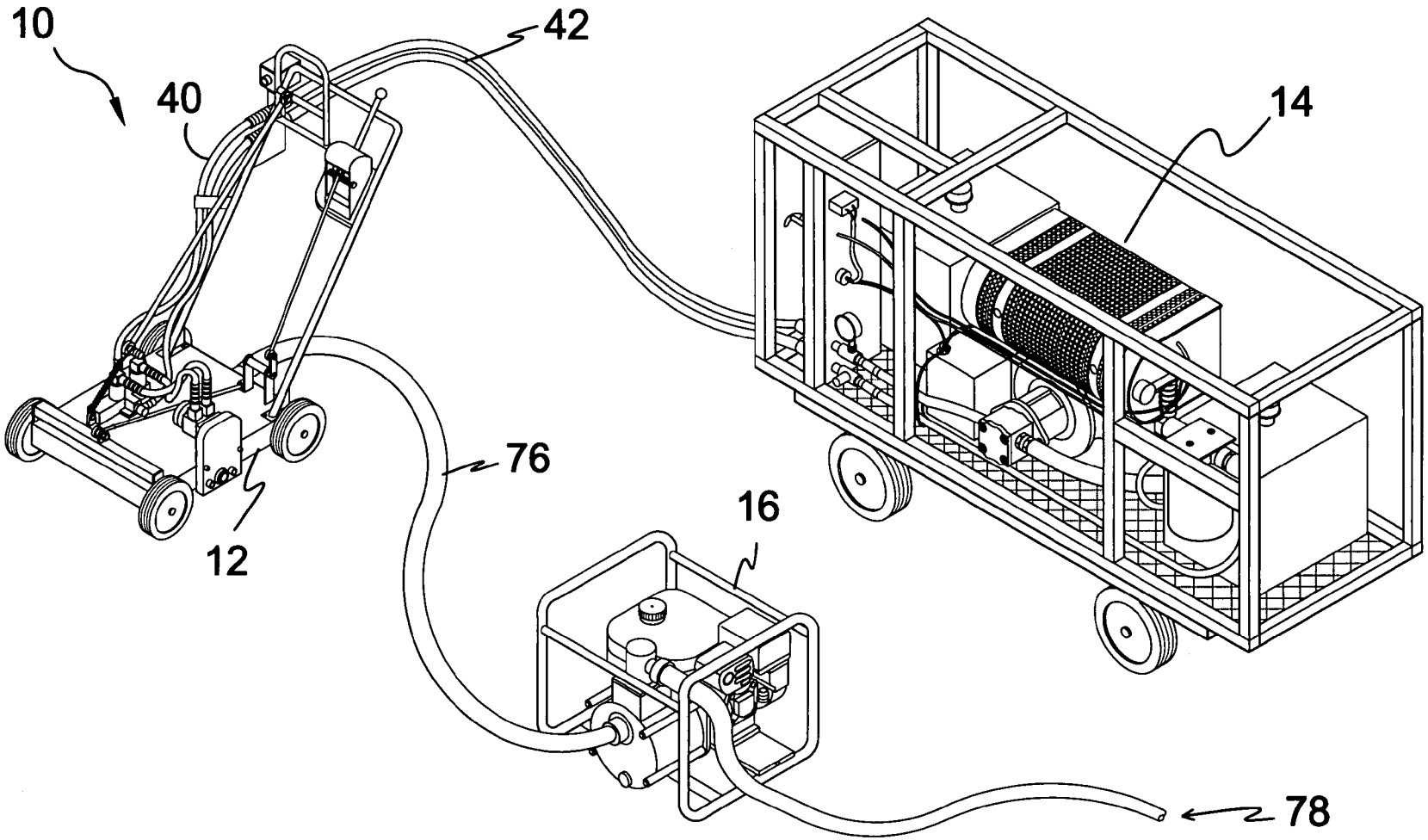
FIG. 2 is an illustrative view of the present invention.

FIG. 2 is an illustrative view of the present invention 10. The present invention is a dredge unit 10 comprising a submersible housing having a hydraulically driven cutter blade incorporating means for engaging and disengaging said cutter blade. The dredge apparatus 10 includes a remote hydraulic power plant 14 and a trash pump 16. The hydraulic power plant 14 has hydraulic hose lines 42 that connect to the hydraulic hose lines 40 of the dredge unit 12. The trash pump 16 includes a suction line 76 in communication with the dredge unit 12 and a discharge line 78 for disposing of the dredged material.

Figure 3:
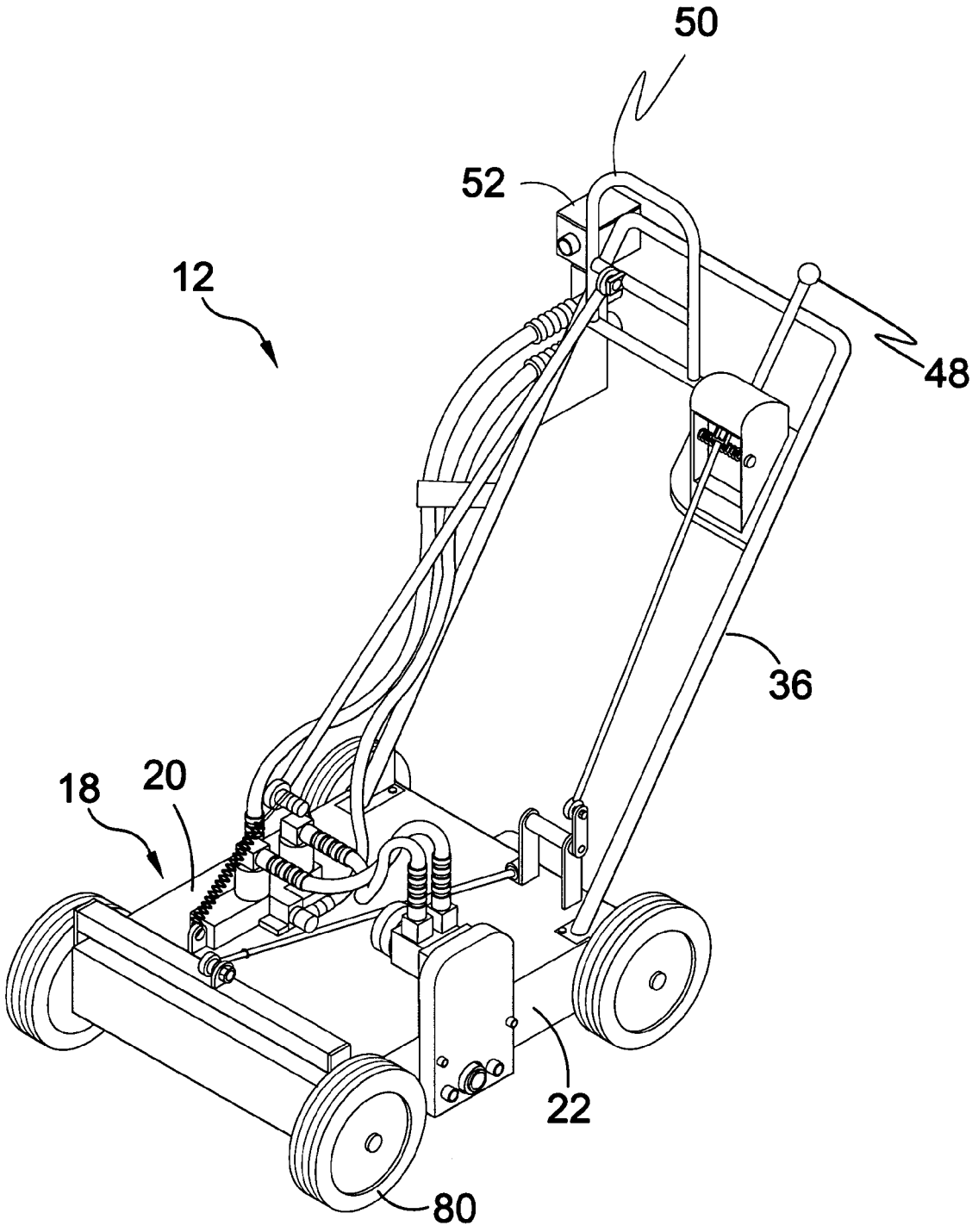
FIG. 3 is a perspective view of the dredger of the present invention.

FIG. 3 is a perspective view the dredge unit 12 of the present invention. The dredge unit 12 is small, similar to a large lawn mower or snow blower. The housing 18 of the dredge unit 12 includes a deck platform 20 with sidewalls 22 extending downward therefrom. A handle member 36 extends from the housing 18 and has a plurality of user controls 46 mounted thereon including a cutter-depth adjustment control 48, a dead man's clutch 50 and an emergency kill switch 52. Height adjustable front wheels 80 are shown on the housing 18.

Figure 4:
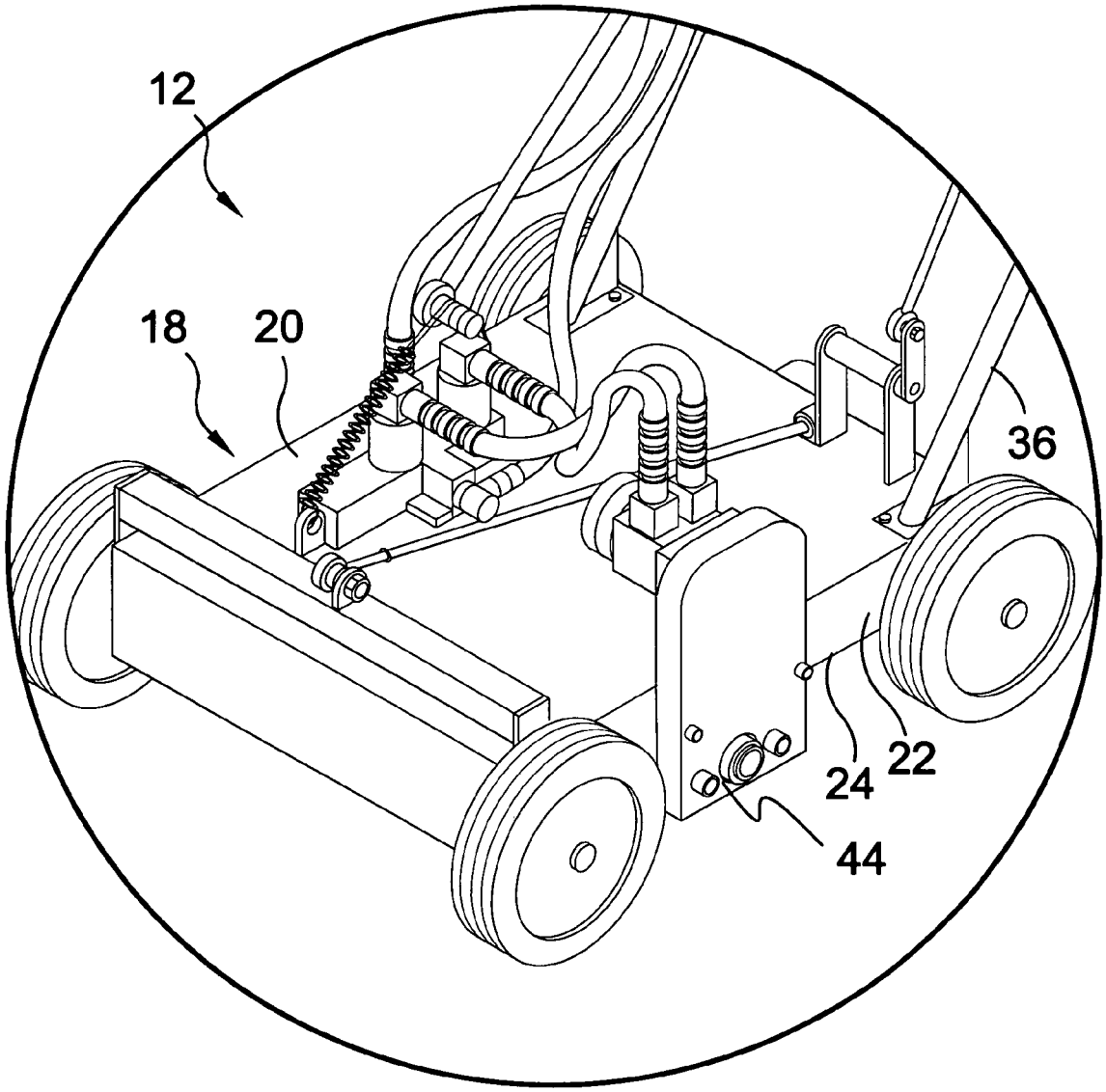
FIG. 4 is a detailed perspective view of the dredger deck of the present invention.

FIG. 4 is a detailed perspective view the housing 18 of the dredge unit 12. The dredge unit 12 is small, similar to a large lawn mower or snow blower. The housing 18 of the dredge unit 12 includes a deck platform 20 with sidewalls 22 extending downward therefrom. A handle member 36 extends from the housing 18. Cutter blades within the undercarriage 24 of the housing 18 loosen up mud and cut away soft stone (limestone) which is then removed through a suction hose. The cutter blades are powered by a hydraulically-operated chain drive 44. A separate hydraulic power plant remains on shore or in a boat.

Figure 5:
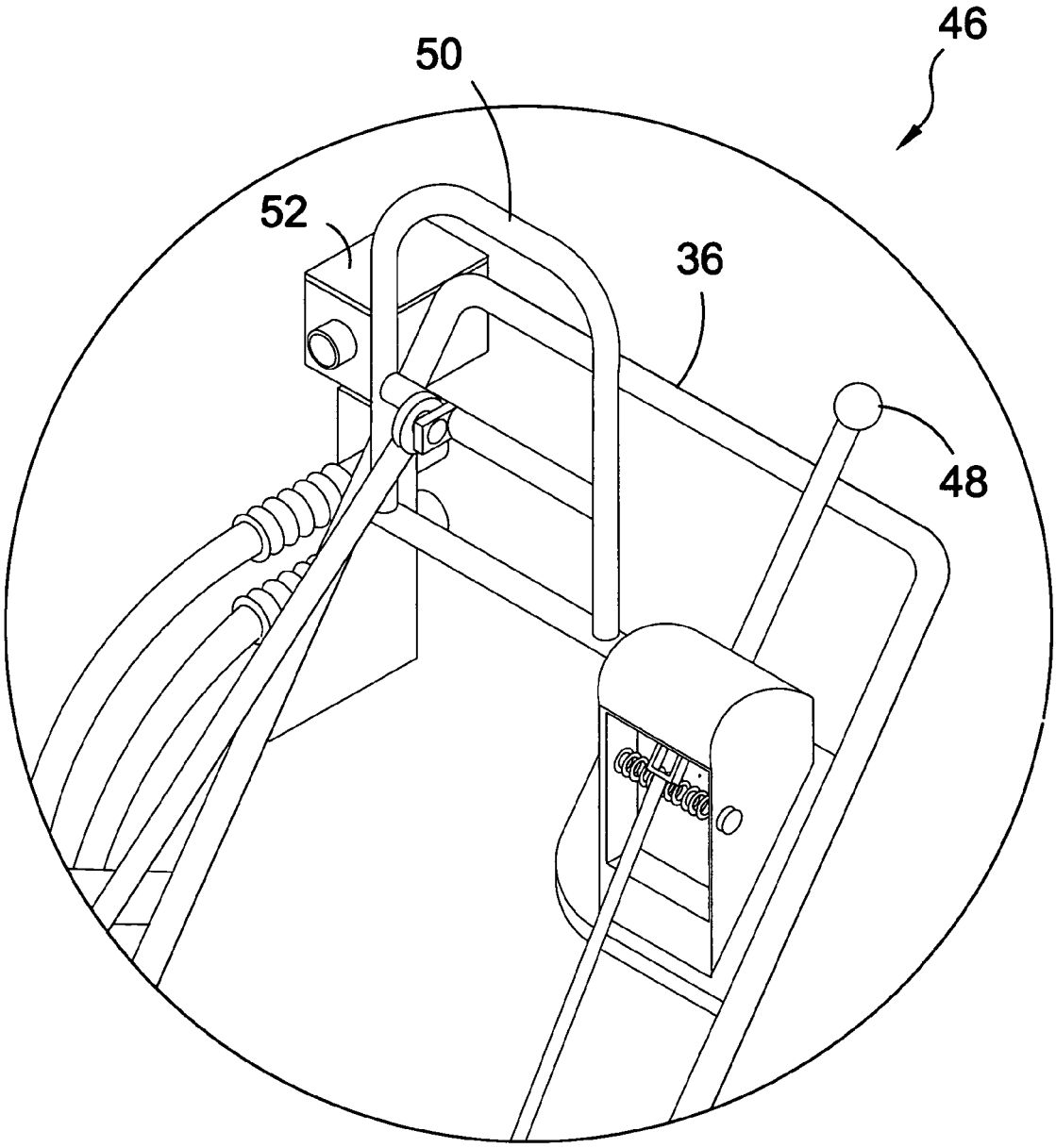
FIG. 5 is a detailed view of the present invention.

FIG. 5 is a detailed view of the user controls 46 of the present invention. A handle member 36 extends from the housing 18 and has a plurality of user controls 46 mounted thereon including a cutter-depth adjustment control 48, a dead man's clutch 50 and an emergency kill switch 52. The dead man's clutch engages 50 the cutting blade when depressed and disengages it immediately upon being released.

Figure 6:
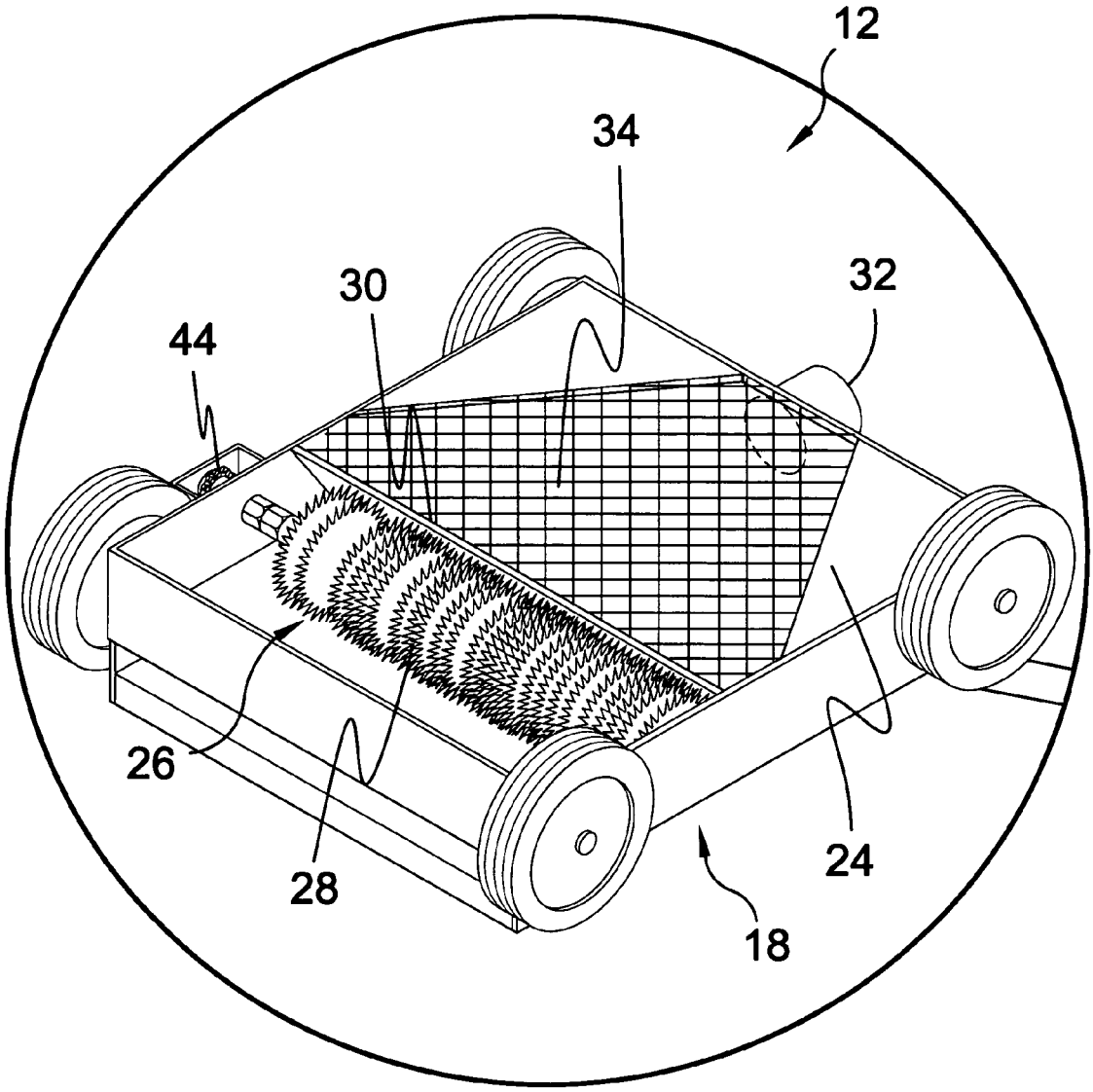
FIG. 6 is a detailed view of the under deck of the present invention's dredge.

FIG. 6 is a detailed view of the undercarriage 24 of the dredge unit 12. A cutting element 26 comprising a plurality of cutting blades 28 disposed within the undercarriage 24 of the housing 18 serves to loosen up mud and cut away soft stone (limestone) which is then removed through a suction hose connected to the discharge port 32. The cutting element 26 is powered by a hydraulically-operated chain drive 44 mounted on the deck. A separate hydraulic power plant remains on shore or in a boat. A wiper blade 30 serves to dislodge debris retained by the cutting blades 28. The filter screen 34 restricts the passage of debris into the discharge port 32 that is larger than its mesh openings.

Figure 7:
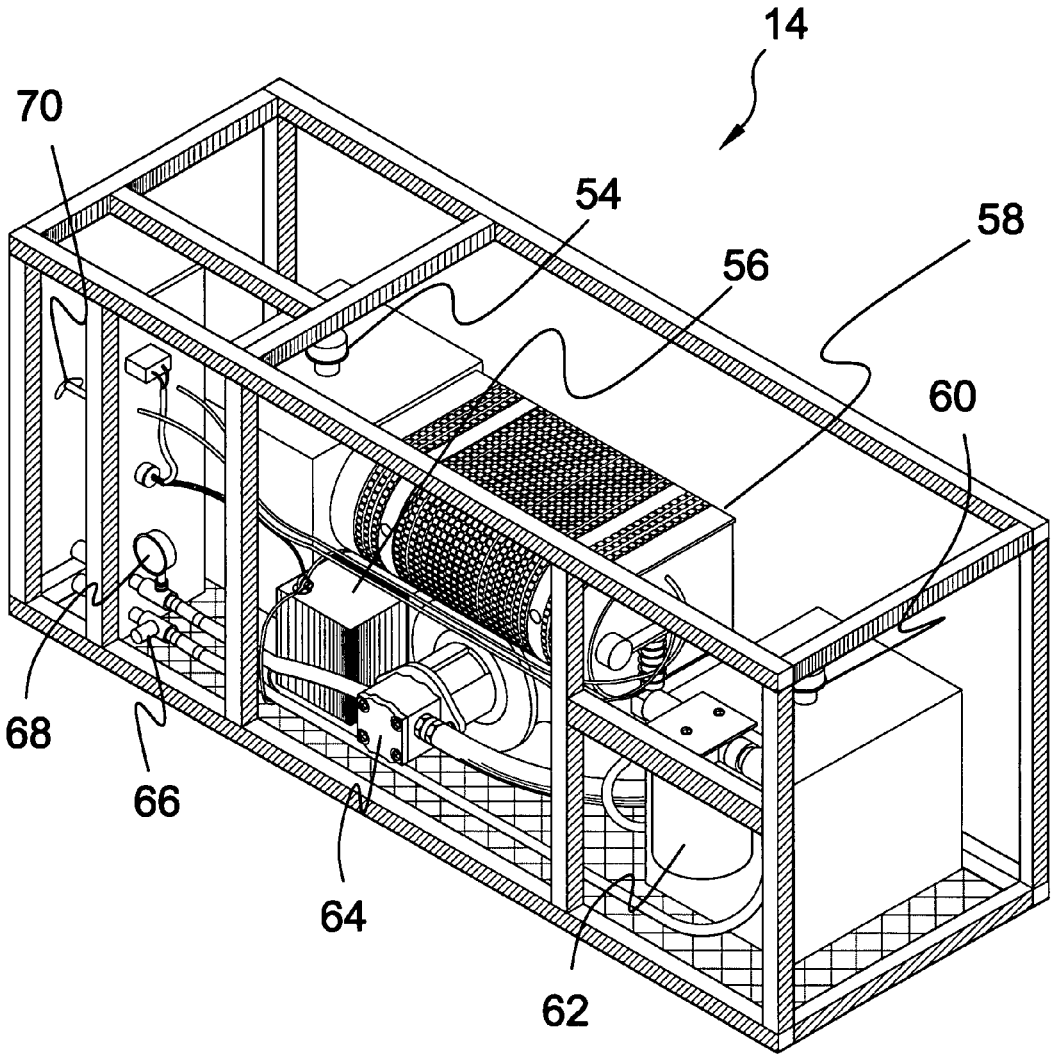
FIG. 7 is a perspective view of the hydraulic power plant of the present invention.

FIG. 7 is a perspective view of the hydraulic power plant 14 of the present invention. Shown are the primary components of the hydraulic power plant 14 including: a gasoline tank 54, a battery 56, an engine 58, a hydraulic fluid tank 60, a hydraulic fluid filter 62, a hydraulic pump 64, a pressure regulator 66, a pressure gauge 68 and a throttle 70.

Figure 8:
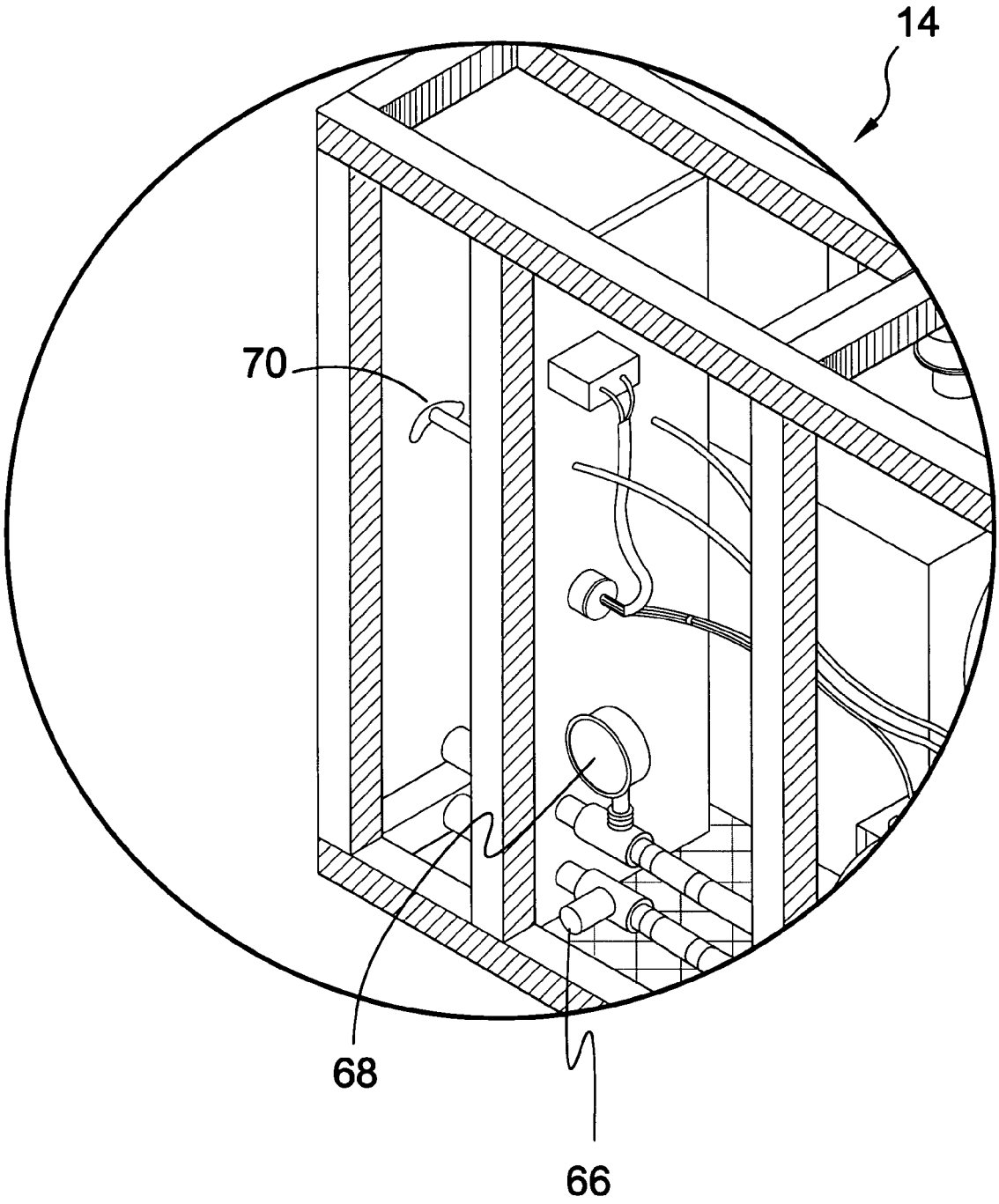
FIG. 8 is a detailed view of the hydraulic power plant of the present invention.

FIG. 8 is a detailed view of the hydraulic power plant 14 of the present invention showing the throttle 70, the pressure gauge 68 and the pressure regulator 66. Dredging equipment is normally enormous and expensive, the dredge equipment of the present invention is small and can enter the water from a beach or be lowered into the water by a boatlift. An area around an owner's dock or swimming area could be cleaned up and/or deepened in a matter of hours with little impact, noise or expense. The dredge is small, similar to a large lawn mower or snow blower. Cutter blades on the underside of the mower deck loosen up mud and cut away soft stone (limestone) which is then removed through a suction hose. The cutter blades are powered by a hydraulic motor mounted on the deck. A separate hydraulic power plant remains on shore or in a boat.

Figure 9:
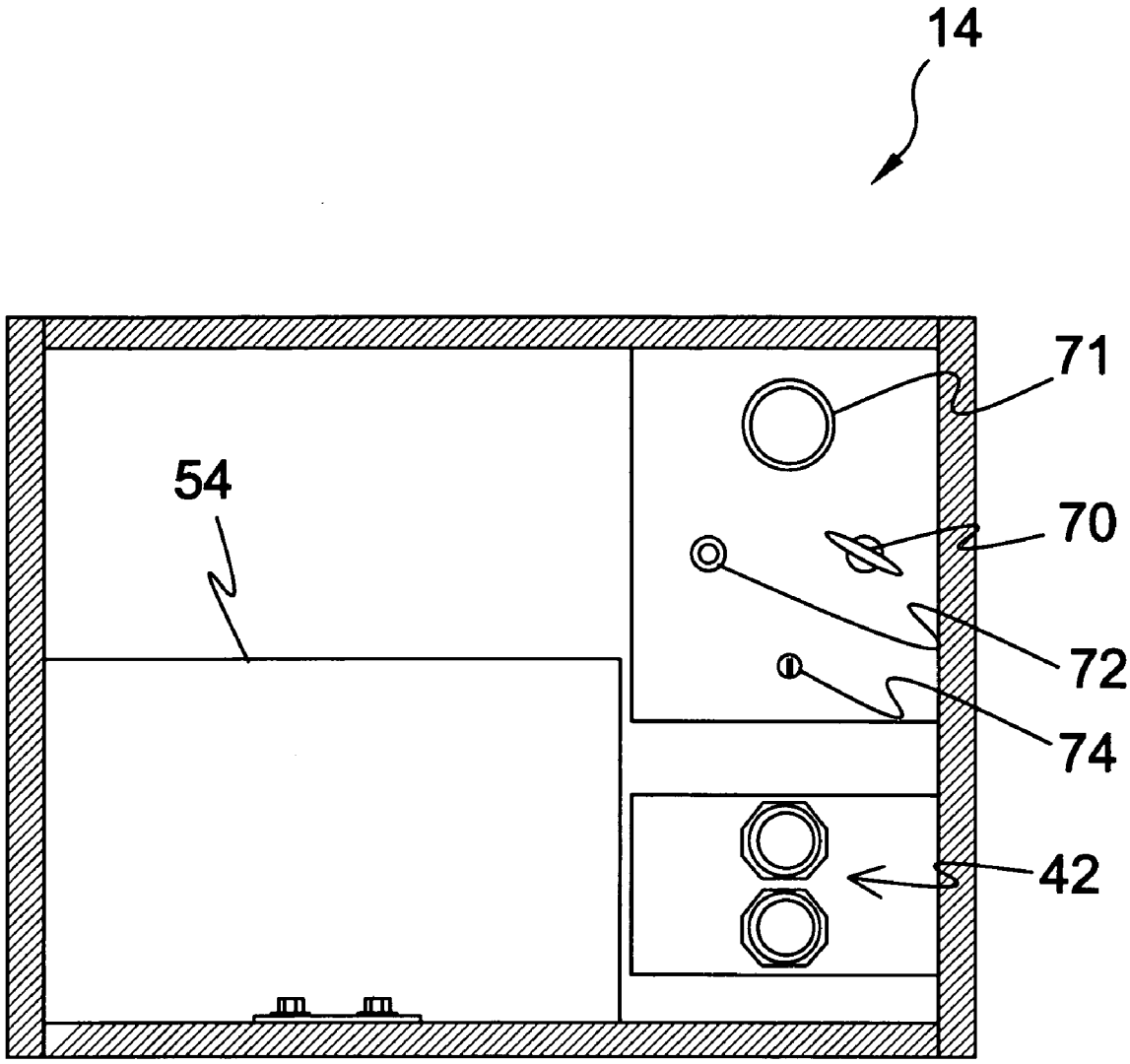
FIG. 9 is a detailed view of the hydraulic power plant of the present invention.

FIG. 9 is a detailed view of the hydraulic power plant 14 of the present invention showing the gasoline tank 54, hours meter 71, throttle 70, choke 72, ignition 74 and the hydraulic hose lines 42. Dredging equipment is normally enormous and expensive, the dredge equipment of the present invention is small and can enter the water from a beach or be lowered into the water by a boatlift. An area around an owner's dock or swimming area could be cleaned up and/or deepened in a matter of hours with little impact, noise or expense. The dredge is small, similar to a large lawn mower or snow blower. Cutter blades on the underside of the mower deck loosen up mud and cut away soft stone (limestone) which is then removed through a suction hose. The cutter blades are powered by a hydraulic motor mounted on the deck. A separate hydraulic power plant remains on shore or in a boat.

Figure 10:
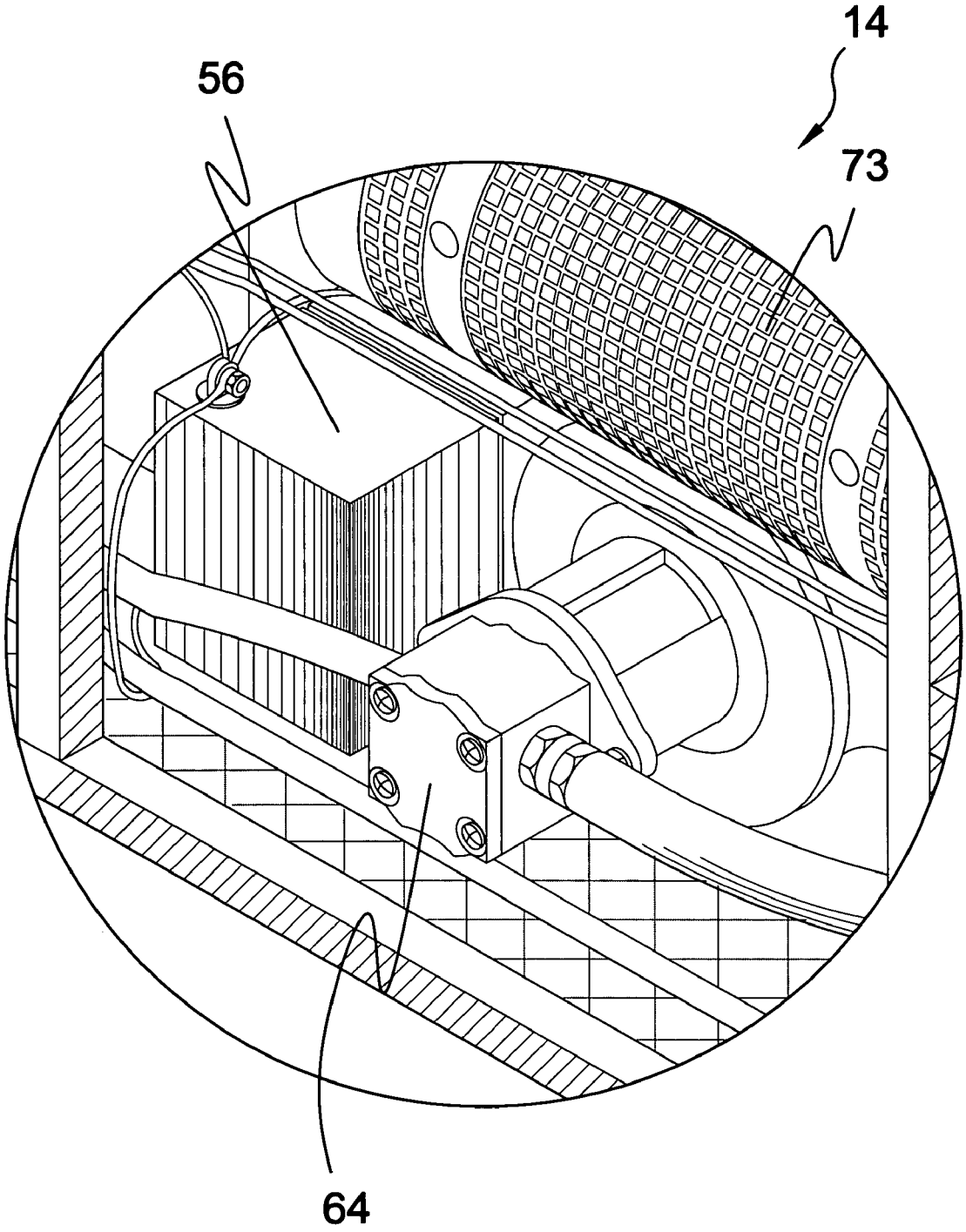
FIG. 10 is a detailed view of the hydraulic power plant of the present invention.

FIG. 10 is a detailed view of the hydraulic power plant 14 of the present invention showing the hydraulic pump 64, the battery 56 and the engine muffler 73. Dredging equipment is normally enormous and expensive, the dredge equipment of the present invention is small and can enter the water from a beach or be lowered into the water by a boatlift. An area around an owner's dock or swimming area could be cleaned up and/or deepened in a matter of hours with little impact, noise or expense. The dredge is small, similar to a large lawn mower or snow blower. Cutter blades on the underside of the mower deck loosen up mud and cut away soft stone (limestone) which is then removed through a suction hose. The cutter blades are powered by a hydraulic motor mounted on the deck. A separate hydraulic power plant remains on shore or in a boat.

Figure 11:
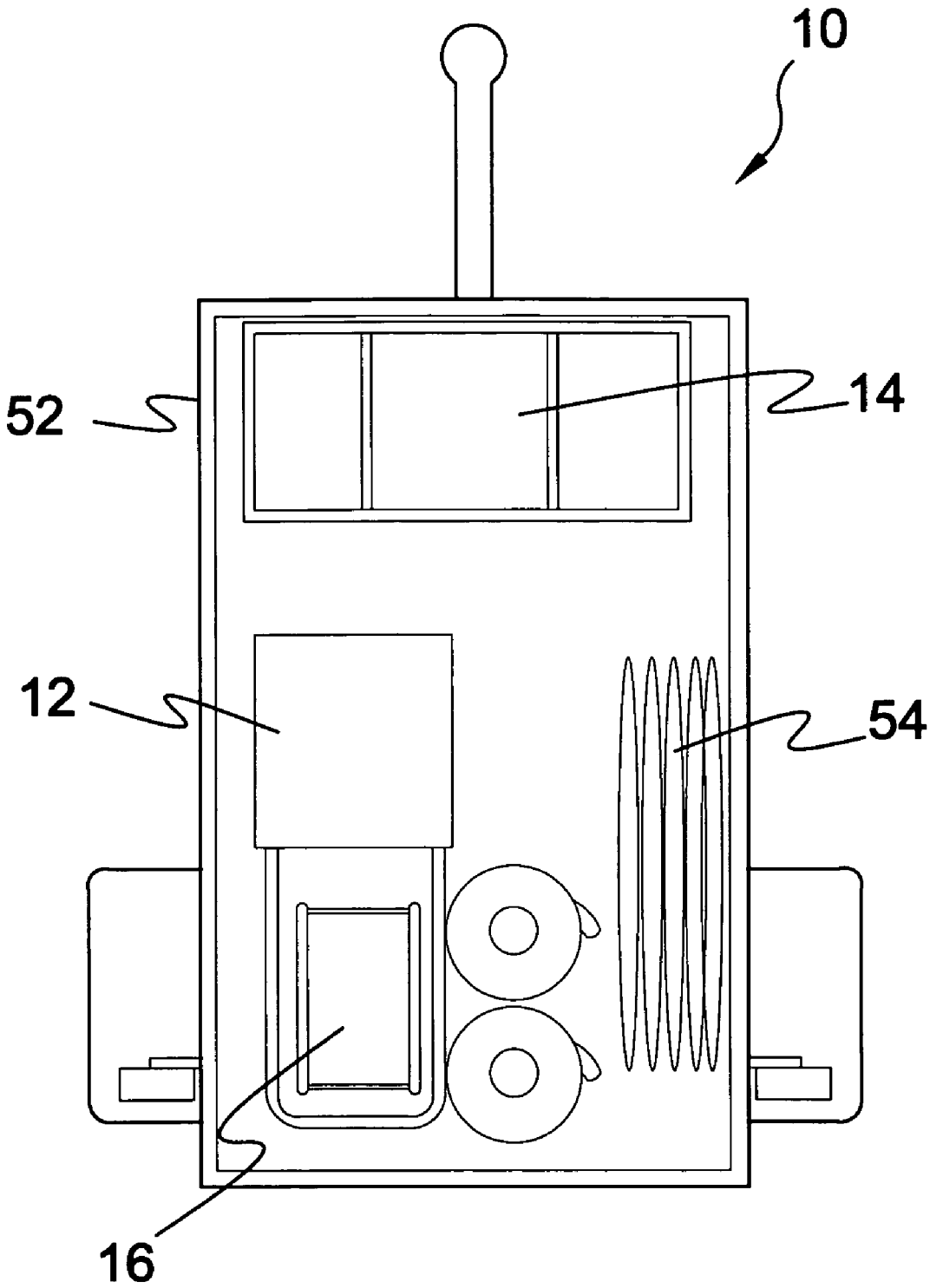
FIG. 11 is a top view of the hydraulic power plant of the present invention on trailer.

FIG. 11 is a top view of the present invention 10 on a trailer 82. The dredge unit 12, hydraulic power plant 14 and trash pump 16 of the present invention 10 are stored and carried within a trailer 82 to its work destination and is small and can enter the water from a beach or be lowered into the water by a boatlift. There is also a hose storage area 84. An area around an owner's dock or swimming area could be cleaned up and/or deepened in a matter of hours with little impact, noise or expense. The dredge is small, similar to a large lawn mower or snow blower. Cutter blades on the underside of the mower deck loosen up mud and cut away soft stone (limestone) which is then removed through a suction hose. The cutter blades are powered by a hydraulic motor mounted on the deck. A separate hydraulic power plant remains on shore or in a boat.

Figure 12:
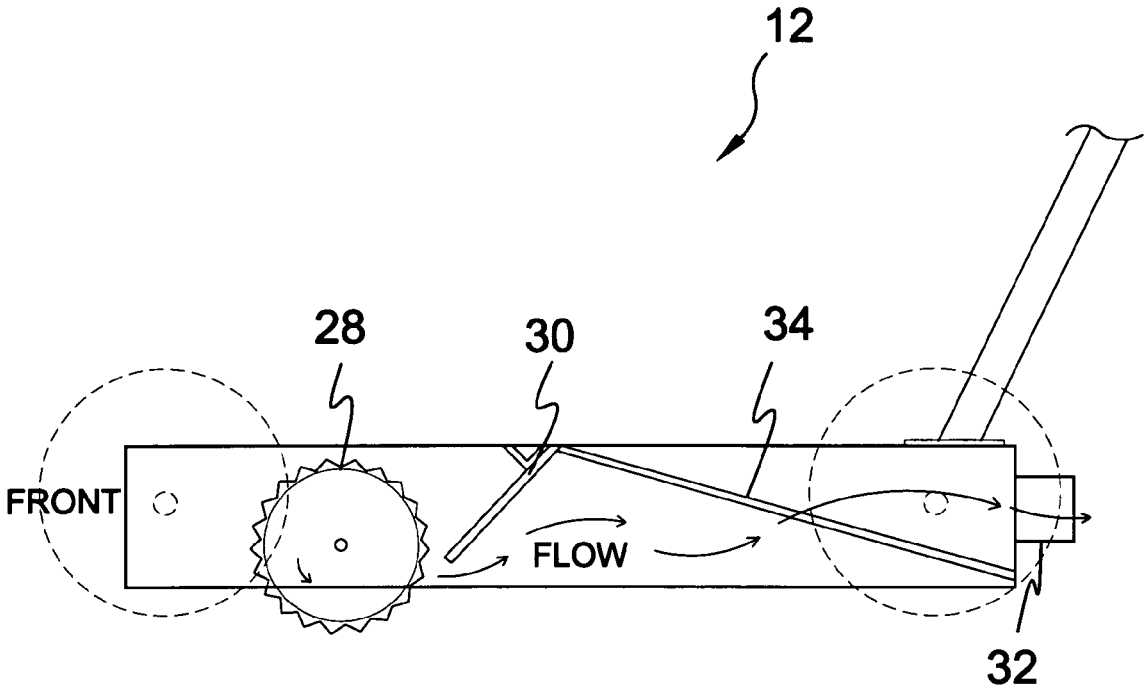
FIG. 12 is a partial side view of the dredge unit of the present invention.

FIG. 12 is a partial side view of the dredge unit 12 of the present invention. The dredge unit 12 of the present invention is small, similar to a large lawn mower or snow blower, cutter blades 28 on the underside loosen up mud and cut away soft stone (limestone) which is then removed through suction hose attached to the discharge port 32. The cutter blades 28 have excessive debris removed therefrom by the wiper blade 30 and a screen 34 filters out larger particles prior to introduction through the discharge port 32.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A portable dredging apparatus comprising:

a) a submersible, hand-operated dredge unit comprising:
   i) a housing having a platform with a plurality of vertically-extending sidewalls depending downward from the edges thereof thereby defining an undercarriage;
   ii) a cutting element disposed within said undercarriage comprising a hydraulically-operated axle having a plurality of cutting blades extending therefrom;
   iii) a wiper blade proximal said cutting element for removing excessive debris retained by said cutting blades;
   iv) a discharge port for removing the resultant sludge dislodged and agitated by said cutting element;
   v) a mesh filter screen disposed between said cutting element and said discharge port for restricting the size of debris entering said discharge port;
   vi) a handle member extending from said platform to allow a user to manipulate said dredge unit; and
   vii) user controls mounted on said handle member;
b) a portable hydraulic power plant having hydraulic hose lines in communication with said dredge unit; and
c) a trash pump in communication with said discharge port of said dredge unit.

2. A portable dredging apparatus as recited in claim 1, wherein said dredge unit further comprises a hydraulic motor powering a chain drive to rotate said cutting element.

3. A portable dredging apparatus as recited in claim 2, wherein said user controls include:

a) a cutter-depth adjustment means;
b) a dead man's clutch; and
c) an emergency kill switch.

4. A portable dredging apparatus as recited in claim 3, wherein said hydraulic power plant comprises:

a) a gasoline tank;
b) a battery;
c) an engine;
d) an hydraulic fluid tank;
e) an hydraulic fluid filter element;
f) an hydraulic pump;
g) a pressure regulator;
h) a pressure gauge;
i) a throttle;
j) a choke; and
k) an ignition.

5. A portable dredging apparatus as recited in claim 4, wherein said trash pump includes a suction line to be connected to said discharge port of said dredge unit and a discharge line for selectively depositing the dredged material.

6. A portable dredging apparatus as recited in claim 5, wherein said dredging apparatus is set up for operation by:

a) attaching said hydraulic lines to said hydraulic power plant and said dredge unit;
b) connecting said suction line to said discharge port and said trash pump and running the discharge line to the desired location;
c) starting said engine of said hydraulic power plant and setting the user controls to the appropriate settings; and
d) submerging said dredge unit at the location to be dredged.

7. A portable dredging apparatus as recited in claim 6, wherein said dredge unit is operated by the user in the water by depressing said dead man's clutch to engage said cutting element which will rotate as long as said clutch is held against the handle member and will disengage immediately upon release.

8. A portable dredging apparatus as recited in claim 7, wherein said cutting element can be selectively raised and lowered by the user during operation by using said cutter depth adjustment control.

9. A portable dredging apparatus as recited in claim 8, wherein the user moves said dredge unit along the surface to be dredged while said cutting element loosens mud and cuts soft stone which is then removed through said discharge port by said trash pump.

10. A portable dredging apparatus as recited in claim 1, wherein said dredge unit further includes height-adjustable wheels disposed at the corners of said platform.

11. A portable dredging apparatus as recited in claim 1, further including a trailer for transporting said dredge unit, said hydraulic power plant and said trash pump.

* * * * *